US007131856B2

(12) United States Patent
Hoisington et al.

(10) Patent No.: US 7,131,856 B2
(45) Date of Patent: Nov. 7, 2006

(54) INTERMESHING INSULATION-PIERCING ELEMENTS FOR AN INSULATION-PIERCING CONNECTOR

(75) Inventors: Mark A. Hoisington, Austin, TX (US); Brian C. Inberg, Cedar Park, TX (US); Charles Mitchell, Austin, TX (US); Walter R. Romanko, Austin, TX (US); Richard D. Twigg, Leander, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/072,008

(22) Filed: Mar. 4, 2005

(65) Prior Publication Data

US 2006/0199422 A1 Sep. 7, 2006

(51) Int. Cl.
*H01R 4/24* (2006.01)

(52) U.S. Cl. ..... 439/411

(58) Field of Classification Search ..... 439/411–413, 439/811, 812; 174/84 C, 90
See application file for complete search history.

(56) References Cited

U.S. PATENT DOCUMENTS 3,546,660 A * 12/1970 Bottcher et al. ..... 439/413
3,549,786 A * 12/1970 Kuo ..... 174/84 C
3,814,836 A * 6/1974 Neale, Sr. ..... 174/84 C
3,825,881 A * 7/1974 Wigby ..... 439/422
4,032,212 A * 6/1977 Faust et al. ..... 439/412
4,176,893 A * 12/1979 Olszewski et al. ..... 439/99
4,247,159 A * 1/1981 Fruchard ..... 439/431
4,427,253 A * 1/1984 Smith et al. ..... 439/413
4,640,571 A * 2/1987 Walter et al. ..... 439/791
4,643,512 A 2/1987 Prodel
4,684,196 A * 8/1987 Smith et al. ..... 439/411
4,867,700 A * 9/1989 Kreinberg ..... 439/422
5,004,437 A * 4/1991 Walter et al. ..... 439/811
5,112,245 A * 5/1992 Shimirak et al. ..... 439/412
5,772,455 A * 6/1998 Auclair et al. ..... 439/100
6,086,406 A 7/2000 Francois et al.

* cited by examiner

*Primary Examiner*—Gary F Paumen

(57) ABSTRACT

An electrical connector includes a first jaw having a first set of insulation-piercing elements and a second jaw having a second set of insulation-piercing elements. The first and second sets of insulation-piercing elements are arranged such that at least one row of insulation-piercing elements from the first set of insulation-piercing elements is able to intermesh with at least one row of insulation-piercing elements from the second set of insulation-piercing elements when the first and second jaws are moved towards one another along a z-coordinate.

20 Claims, 13 Drawing Sheets

INTERMESHING INSULATION-PIERCING ELEMENTS FOR AN INSULATION-PIERCING CONNECTOR

BACKGROUND

The present invention relates to an electrical connector for connecting electrical cable conductors, and more particularly to an electrical connector having insulation-piercing elements for use with an insulated electrical cable conductor.

Electrical connectors are often used for connecting cable conductors together. For example, an electrical connector may be used as a branch connector when electrical power is distributed from a power generation plant to consumers of electrical power. The electrical connector may have one or more openings for receiving an electrical cable conductor ("cable"). A cable is typically round in cross-section and formed of a conductive core (typically copper or aluminum) and may be surrounded by one or more layers of insulating material ("insulative coating"). Additionally, multiconductor cable constructions containing sector shape (i.e., a pie shape) insulated conductors with an overall outer sheath are used in some countries. An electrical connector may be an insulation-piercing connector ("IPC"), which incorporates insulation-piercing elements in the cable-receiving opening in order to create an electrical connection between the electrical connector and the insulated cable. The IPC may include a fixed jaw and a movable jaw, where the movable jaw creates an opposing force on a cable which is engaged between the fixed jaw and the moveable jaw. The movable jaw may be actuated by a threaded bolt extending through a threaded bore in the electrical connector body. A cable may be inserted between the jaws, and as the bolt is turned, the movable jaw moves toward the fixed jaw and engages the cable. An IPC may also be formed by a bolt and a fixed jaw, where the bolt creates an opposing force on the engaged cable.

Where an IPC has two opposing jaws, insulation-piercing elements (e.g., teeth) are typically formed on each jaw in order to pierce an insulative covering of the cable and make electrical contact with the conductive cover of the cable as the movable jaw is clamped down on the cable. The teeth may be essentially two-dimensional or fully three-dimensional. In order to cover a range of cable sizes, it may be preferred to arrange the teeth with their initial cable contacting surfaces in an arced profile on each jaw, so that the teeth contact as much of the cable perimeter as possible for low contact resistance. In current IPC designs, where a fixed jaw and moveable jaw configuration is used, the opposing sets of teeth are typically mirror images of one another.

An IPC may also be used in other applications that require creating an electrical connection through an insulated cable. An IPC may be used because of shorter cable installation time due to little or no cable preparation (e.g., there is no need to strip insulation from a cable in order to establish electrical contact). The design of an IPC requires a balance between several different criteria, including, but not limited to, a low penetration force through the insulative layer of the cable, the ability to penetrate and displace the insulation, low total installation force (or torque), low damage to the cable, low contact resistance, low overall Joule heating, good long term electrical connection stability, and a sufficient grip on the cable ("strain relief") to prevent cable movement and dislodgment from the connection.

It may also be desirable for an IPC to be "range-taking". That is, it may be desirable to have an IPC that has the ability to connect reliably to a wide range of cable sizes (e.g., different cable diameters). It has been found that a broad range-taking capability may be difficult to achieve with current IPC designs because when the teeth on opposed jaws in an IPC are closed down onto a small diameter cable, some of the teeth may crash into each other, preventing the proper force from being applied to the cable.

BRIEF SUMMARY

In a first aspect, the present invention is an insulation piercing connector including a first jaw and a second jaw. The first jaw includes a first set of insulation-piercing elements, which are arranged along orthogonal x-y coordinates, and the second jaw includes a second set of insulation-piercing elements, which are arranged along the orthogonal x-y coordinates. The first jaw opposes the second jaw and is moveable relative to the second jaw along an orthogonal z-coordinate. The first and second sets of insulation-piercing elements are arranged such that at least one y-coordinate-extending row of insulation piercing elements of the first set of insulation-piercing elements is able to intermesh with at least one y-coordinate-extending row of insulation-piercing elements of the second set of insulation-piercing elements along the x-y coordinates when the first jaw is moved towards the second jaw along the z-coordinate.

In a second aspect, the present invention is a device for forming an electrical connection to an insulated cable. The device includes a first jaw and a second jaw. The first jaw includes a first set of inner insulation-piercing elements and a first set of outer insulation-piercing elements, and the second jaw includes a second set of inner insulation-piercing elements and a second set of outer insulation-piercing elements. The first jaw opposes the second jaw, and the first and second set of outer insulation-piercing elements are arranged such that the first and second set of outer insulation-piercing elements intermesh along orthogonal x-y coordinates when the first jaw is moved towards the second jaw along an orthogonal z-coordinate.

In a third aspect, the present invention is an electrical connector including a first jaw and a second jaw. The first jaw includes a first set of teeth for piercing an insulative coating of a cable to electrically contact a conductive core of the cable. The second jaw opposes the first jaw and includes a second set of teeth for piercing the insulative coating of the cable to electrically contact the conductive core of the cable. Selected teeth from the first set of teeth and corresponding selected teeth from the second set of teeth form matching opposed arrays. The opposed teeth of each matching array are arranged on their respective jaws such that they do not contact one another when the first and second jaws are moved together to engage the cable. The electrical connector has a cable diameter range taking capability of at least one to two.

The above summary is not intended to describe each disclosed embodiment or every implementation of the present invention. The figures and the detailed description which follow more particularly exemplify illustrative embodiments.

BRIEF DESCRIPTION OF THE DRAWINGS

The present invention will be further explained with reference to the drawing figures listed below, where like structure is referenced by like numerals throughout the several views.

While the above-identified figures set forth one or more embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention.

DETAILED DESCRIPTION

The present invention is an IPC having opposing jaws, where at least some insulation-piercing elements of the opposing jaws intermesh when the jaws are clamped together. Preferably, at least the outer insulation-piercing elements of the opposing jaws intermesh. The insulation-piercing elements intermesh due to an arrangement of the elements on each jaw. The intermeshing enables the IPC to have a greater cable diameter range-taking capability because the absence of some or all of the "crashing" of opposed elements may enable the IPC to make electrical contact with not only large diameter, but also very small diameter conductors. The intermeshing also maintains a sufficient grip (i.e., a high level of "strain relief") on a cable that is engaged between its jaws over a wider range of cable sizes, as compared to current IPC designs. The high level of strain relief helps to prevent the cable from becoming dislodged from both the mechanical and electrical connections. The staggering of certain opposed insulation-piercing elements of an IPC in accordance with the present invention also allows the elements to be shorter as compared to current IPC elements, because the staggered design allows more room in which cable insulation may be displaced. As used herein, "staggered" and "offset" are used interchangeably.

Figure 1:
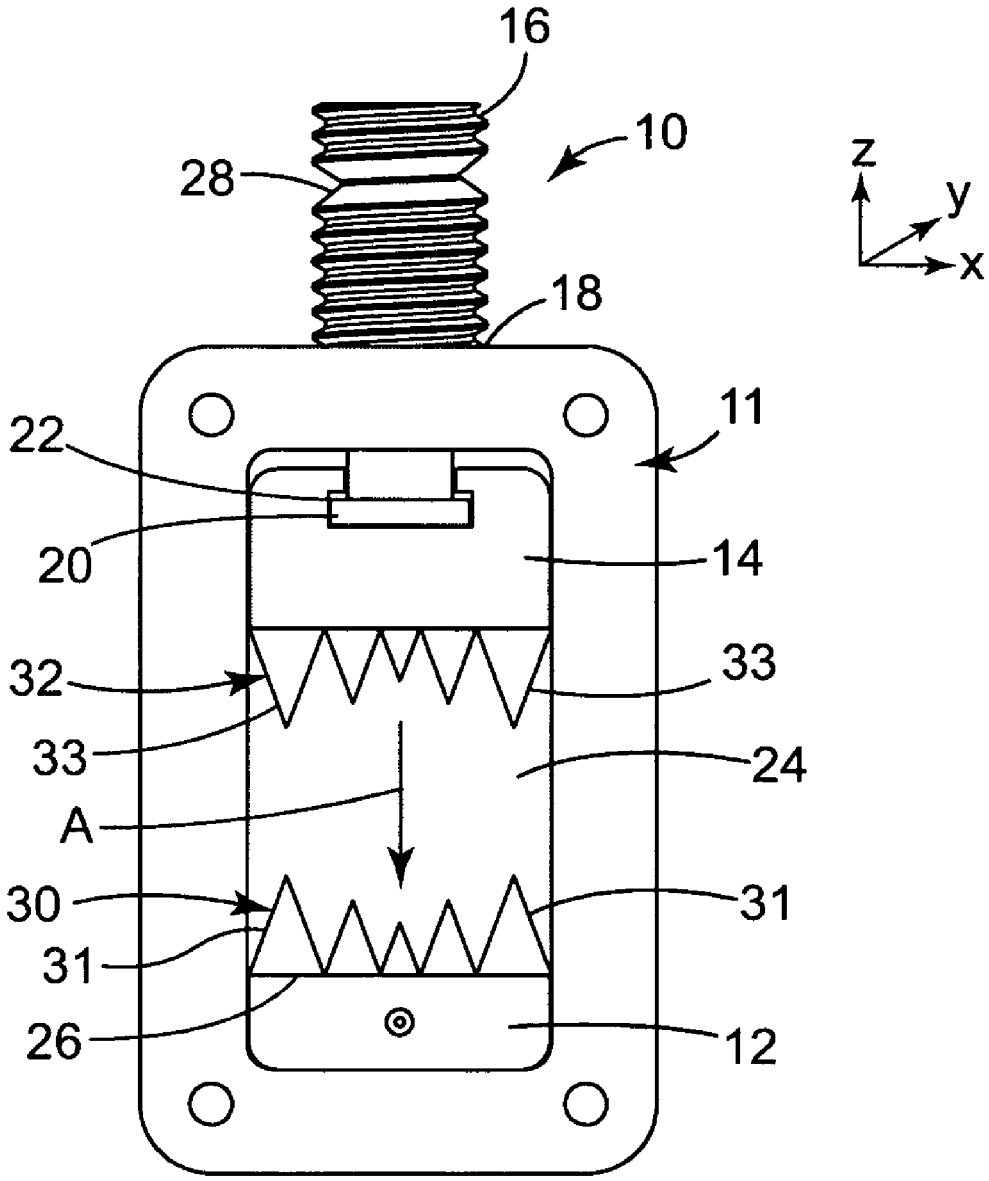
FIG. 1 is a side view of an IPC, as seen from a cable insertion side thereof, where a portion of its outer housing has been removed.

In order to help describe how insulation-piercing elements of an IPC may be able to intermesh, FIG. 1 shows a general IPC structure, which is not intended to limit the scope of the invention in any way.

FIG. 1 is a side view of IPC 10, wherein a portion of outer housing 11 has been removed to show fixed jaw 12, moveable jaw 14, and bolt 16. Moveable jaw 14 opposes fixed jaw 12. Movable jaw 14 moves along a longitudinal z-coordinate axis of housing 11, and is actuated by a threaded bolt 16 extending through a threaded bore 18 in housing 11. Bolt 16 and movable jaw 14 are operably joined by slidably inserting an enlarged round head 20 on bolt 16 into a T-shaped slot 22 in movable jaw 14. In this manner, bolt 16 may rotate along its longitudinal axis relative to movable jaw 14. As bolt 16 is turned and advanced into cavity 24, movable jaw 14 moves along a z-coordinate direction (see orthogonal x-y-z coordinates in FIG. 1), in the direction of arrow A and engages a cable (not shown in FIG. 1) between moveable jaw 14 and fixed jaw 12 (which is disposed on the opposed inner surface 26 of cavity 24). Likewise, when bolt 16 is turned and retracted from the cavity 24, movable jaw 14 moves away from fixed jaw 12 and the grip therebetween loosens on the cable.

Bolt 16 may have torque limiting head 28 that is either integral with bolt 16 or a separate part fixed to bolt 16. Torque limiting head 28 is shearable when excessive torque is applied. In this manner, the compressive force applied by bolt 16 to clamp the cable between jaws 12 and 14 is precisely controlled and limited.

Teeth 30 (including outer rows of teeth 31) are provided on fixed jaw 12 and a corresponding set of teeth 32 (including outer rows of teeth 33) are provided on moveable jaw 14. Teeth 30 and 32 face each other. Teeth 30 and 32 are typically arranged in a plurality of rows and columns, where a "row" extends in a y-coordinate direction and a "column" extends in the x-coordinate direction. Teeth 30 and 32 may be essentially two-dimensional or fully three-dimensional and may be formed in any suitable manner, such as by casting, machining, extruding, or a combination thereof. The specifics of the shape, size, composition, and number of teeth can vary according to the desired inventive tooth arrangement as well as the construction of the cable to be engaged by jaws 12 and 14. For example, the teeth may be pyramidal, triangular, or a fraction of a circle, depending upon aforementioned factors. Teeth 30 and 32 have initial cable contact surfaces which are typically aligned along an arc, relative to an axis of a cable engaged therebetween. The initial cable contact surfaces are those surfaces of teeth 30 and 32 which first contact a cable that is engaged between jaws 12 and 14. The arc-like alignment may enable teeth 30 and 32 to contact as much of the cable perimeter as possible for low contact resistance. An arc-like alignment may be achieved if the teeth in outer rows of teeth 31 and 33 have a greater dimension along the z-coordinate than the other teeth 30 and 32.

As moveable jaw 14 is moved towards fixed jaw 12, teeth 30 and 32 pierce an insulative covering of a cable which is positioned between fixed jaw 12 and moveable jaw 14, thereby creating a mechanical connection with the cable and an electrical contact with a conductive core of the cable. In current IPC designs, teeth 30 and 32 are typically mirror images of one another (as shown in FIG. 1) and/or are aligned such that at least some of teeth 30 and 32 (typically outer teeth 31 and 33) begin to abut and "crash" into one another when moveable jaw 14 is moved towards fixed jaw 12 (along the z-coordinate), which may prevent moveable jaw 14 from creating an electric contact with the cable. The "crashing" teeth decreases the range-taking capability of IPC 10 because as smaller diameter cables are introduced into the IPC, a point is reached where the IPC teeth do not make electrical or mechanical contact with the conductive core of the cable.

The present invention addresses the problem of "crashing" teeth by offsetting (or staggering) teeth 32 on one jaw relative to teeth 30 on the other jaw, so that at least some of teeth 30 and 32 are able to intermesh (if necessary) when moveable jaw 14 is moved towards fixed jaw 12 along the z-coordinate. Preferably, at least outer rows of teeth 31 and 33 are able to intermesh, where "outer" rows of teeth are generally the rows furthest from a center of jaw 12 and/or 14 (i.e., the rows of teeth furthest from an axis of the cable being engaged). It should also be understood where teeth 32 are offset relative to teeth 30, teeth 30 may also be considered offset relative to teeth 32.

In general, teeth 30 and 32 are able to intermesh where at least one tooth of moveable jaw 14 does not have a tooth aligned directly below it on fixed jaw 12, so that there is an opening for the tooth to at least partially fit into. For example, teeth 32 and 30 may be offset in a y-coordinate, where at least one row of teeth 32 are positioned on moveable jaw 14 a small y-coordinate distance from the corresponding row of teeth 30 on fixed jaw 12 (the teeth with which the row from teeth 32 would normally "crash" into, i.e., try to occupy the same space when brought together), where the small distance is at least equal to a thickness of a tooth. If the teeth are not the same thickness, it is preferred that the small offset distance is at least equal to a thickness of the thickest tooth. It is preferred that at least outer rows of teeth 31 and 33 are able to intermesh. Teeth 30 and 32 may also be able to intermesh where rows or columns of teeth on each jaw are offset an appropriate x-coordinate distance from one another. Although only intermeshing teeth by offsetting teeth along the y-coordinate is discussed below, the same concept may be applied to intermeshing by offsetting teeth along the x-coordinate.

Teeth 30 and 32 may also be able to partially intermesh, where a tooth of moveable jaw 14 may have a tooth aligned directly below it on fixed jaw 12, but because of the height and shape of the teeth, a part of the tooth on moveable jaw 14 may intermesh with a part of the opposing tooth on fixed jaw 12. As a result of the partial intermeshing, the teeth do not crash together until moveable jaw 14 and fixed jaw 12 are moved very close to one another. Partial intermeshing will be described below, in reference to FIGS. 8A and 12A.

Teeth 30 and 32 are also able to intermesh where teeth 30 and 32 are not mirror images of one another. For example, teeth 30 and 32 may be arranged to be reverse mirror images of one another. This may occur where the rows and columns of teeth 30 and 32 are positioned on jaws 12 and 14, respectively, to be offset relative to one another (when teeth 30 and 32 face each other). This unique relationship will be seen more clearly in the figures described below.

The present invention is directed towards any suitable arrangement that allows for intermeshing of teeth. The teeth may be arranged to have any suitable base angle (i.e., the angle from which a tooth protrudes from a jaw). The number of rows and columns of teeth as well as the number of teeth shown in the figures described below are also for exemplary purposes. A tooth arrangement in accordance with the present invention may have any suitable number of rows, columns, or teeth. A "tooth" in accordance with the present invention may be any insulation-piercing element which is formed of a conductive material, such as copper, aluminum, or brass. The tooth may also be plated with a material in order to mitigate surface oxidation, degradation, and intermetallic diffusion with a conductive core of a cable. A plated material that has a higher conductivity or lower hardness may also enhance connection resistance with the conductive core of the cable.

Exemplary tooth arrangements are described in reference to FIGS. 2A–13B. The inventive tooth arrangements may be used with most insulation-piercing elements, and the reference to "teeth" is not intended to be limiting. It is preferred that the tooth arrangements are used as diagrams for the position of each tooth. The diagrams are not intended to limit the size or the shape of the teeth used in the configuration, unless otherwise indicated. With each exemplary tooth arrangement described below, it is preferred that the tooth arrangement be used on both a first IPC jaw (e.g., moveable jaw 14) and a second IPC jaw (e.g., fixed jaw 12), where the first and second IPC jaws oppose one another and move together to engage a cable. A "first" IPC jaw and a "second" IPC jaw distinction are used for ease of description and the distinction is not intended to limit the present invention in any way. If the present invention is used with an IPC having a moveable jaw and fixed jaw, the first jaw may correspond to either the moveable jaw or fixed jaw.

Figure 2A:
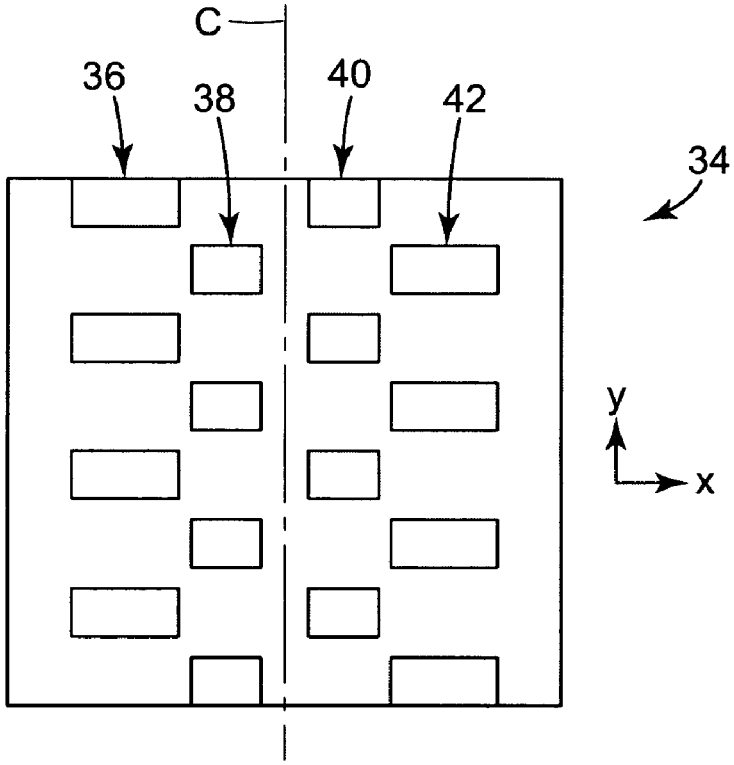
FIG. 2A is a top view diagram of a first exemplary embodiment of a tooth array on an IPC jaw in accordance with the present invention.

FIG. 2A is a top view diagram of a first exemplary embodiment of tooth arrangement 34 on an IPC jaw in accordance with the present invention. Axis C represents a longitudinal axis of a cable which may be engaged between the IPC jaw and an opposing IPC jaw. Tooth arrangement 34 may be used in conjunction with an IPC such as IPC 10, where tooth arrangement 34 is placed on both jaw 12 and 14. Tooth arrangement 34 includes first row 36, second row 38, third row 40, and fourth row 42, where rows 36, 38, 40, and 42 are numbered in the x-coordinate direction. Tooth arrangement may also be arranged so that first row 36 and fourth row 42 switch x-coordinate positions and/or second row 38 and third row 40 switch x-coordinate positions.

It is preferred that tooth arrangement 34 on the first jaw is a reverse mirror image when facing tooth arrangement 34 on the second jaw. The rows of tooth arrangement 34 on the first jaw are arranged as 36, 38, 40, and 42 (moving left-to-right in the x-coordinate direction) and the rows of tooth arrangement 34 on the second, opposing jaw are arranged as 42, 40, 38, and 36 (moving in left-to-right in the x-coordinate direction). As a result:

Row 36 of the first jaw opposes row 42 of the second jaw;
Row 38 of the first jaw opposes row 40 of the second jaw;
Row 40 of the first jaw opposes row 38 of the second jaw; and
Row 42 of the first jaw opposes row 36 of the first jaw.

When tooth arrangement 34 is integrated into an IPC, it is preferred that the IPC have a cable dimension range taking ratio of about 1:2, where 1:2 is the ratio of the smallest diameter cable to the largest diameter cable the IPC may be used to engage. It is even more preferred that the IPC have a cable dimension range taking ratio of 1:6. Furthermore, it is also preferred that the IPC span cable diameters ranging from about 0.13 units to about 0.78 units. When a cable having a diameter near the lower end of the range is enclosed between opposing jaws (which for exemplary purposes are assumed to be aligned in both the x and y-coordinate directions along axis C in FIG. 2A), teeth in opposing rows 36 and 42 of each jaw do not obstruct one another, but are able to intermesh as necessary.

Figure 2B:
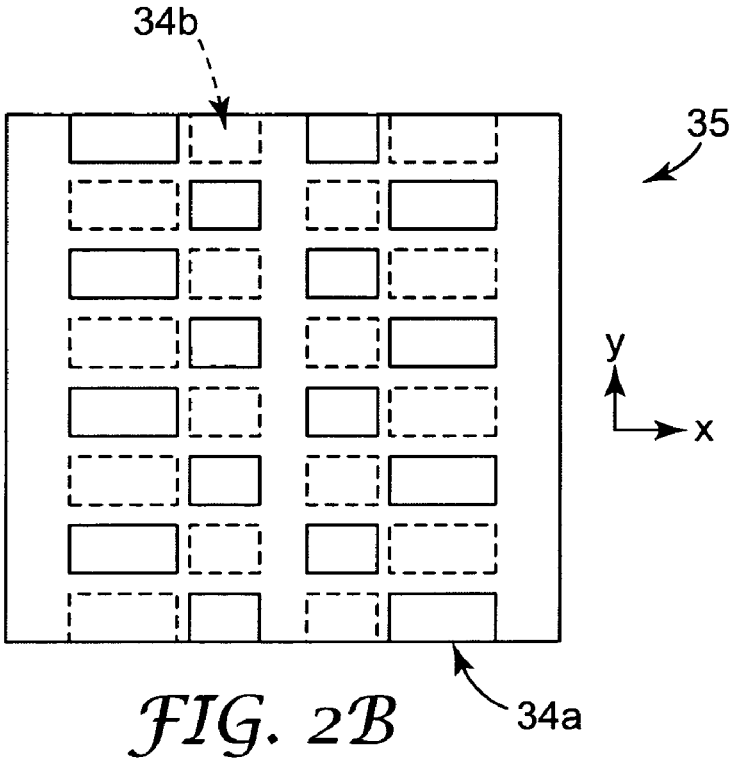
FIG. 2B is a projected top view of an intermeshed tooth arrangement showing how a first set of teeth on a first IPC jaw (shown in solid lines and having the tooth arrangement of FIG. 2A) intermeshes with a second set of teeth on a second, opposed IPC jaw (shown in phantom and having the tooth arrangement of FIG. 2A), where the first and second sets of teeth face each other in a reverse mirror image orientation.

FIG. 2B is a projected top view of intermeshed tooth arrangement 35 showing how a first set of teeth 34*a* on a first IPC jaw (shown in solid lines and having the tooth arrangement of FIG. 2A) intermeshes with a second set of teeth 34*b* on a second, opposed IPC jaw (shown in phantom and having the tooth arrangement of FIG. 2A), where the first and second sets of teeth face each other in reverse mirror image orientations. The first and second IPC jaws are aligned in both the x and y-coordinate directions. As FIG. 2B shows, each tooth is able to "fit" into an opening directly below it on the opposing jaw, thereby intermeshing.

Figure 3A:
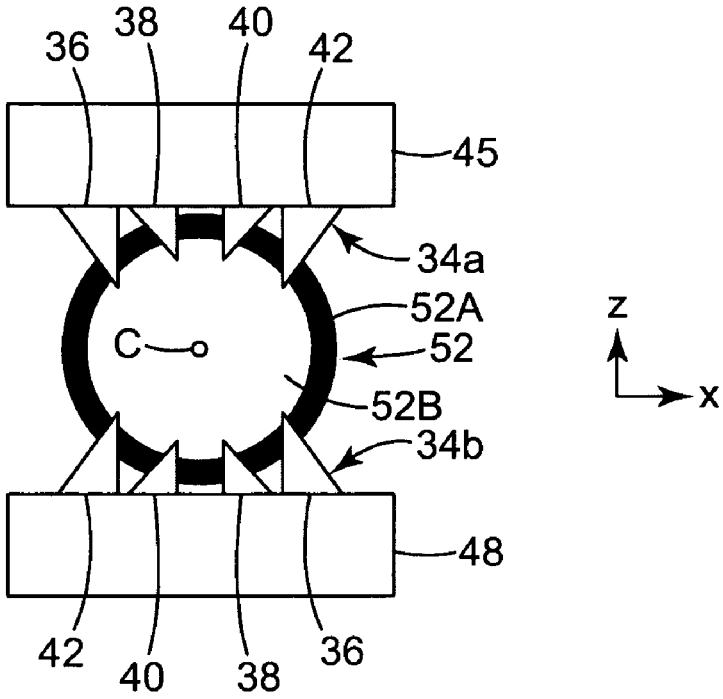
FIG. 3A is side view of a first IPC jaw and a second IPC jaw incorporating the tooth arrangement of FIG. 2A, as urged into an insulation-piercing and conductive relation relative to a cable having a first diameter.
Figure 3B:
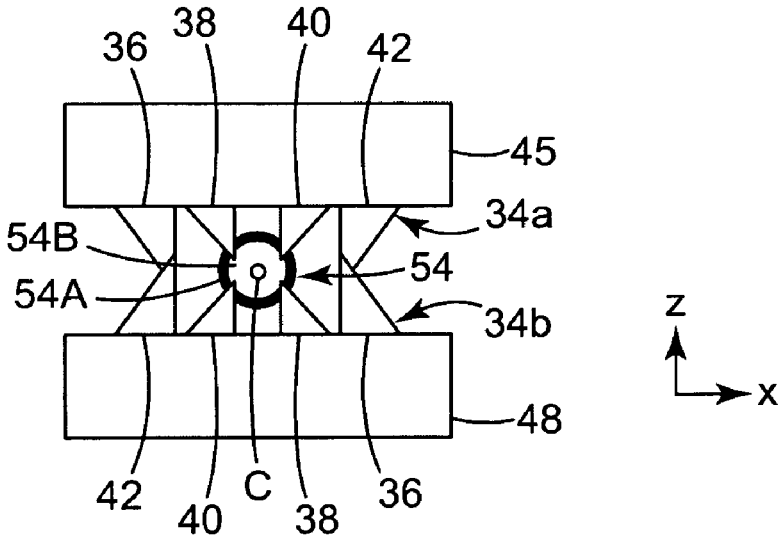
FIG. 3B is a side view like FIG. 3A, showing the inventive tooth arrangement urged into an insulation-piercing and conductive relation relative to a cable having a second, smaller diameter than the cable in FIG. 3A.

FIGS. 3A and 3B are used to show how tooth configuration 34 of FIG. 2A may be incorporated into opposing jaws 45 and 48, and present side views of how the teeth may intermesh. FIG. 3A is side view of first IPC jaw 45 and second IPC jaw 48, which each incorporate tooth arrangement sets 34*a* and 34*b*, respectively, as urged into an insulation-piercing and conductive relation relative to cable 52. Tooth arrangements are reverse mirror images of one another, and are aligned in both the x and y-coordinate directions along axis C. Cable 52 has insulative coating 52A and conductive core 52B, and a longitudinal axis of the cable runs perpendicular to the plane of the image, as indicated by axis C. Teeth 34*a* and 34*b* pierce insulative coating 52A and make an electrical connection with conductive core 52B. Cable 52 preferably has a diameter in the higher range of an IPC's range-taking capability. With a large diameter cable 52, "crashing" teeth may not be a concern because jaws 45 and 48 may not move close enough to one another for teeth 34*a* and 34*b* to touch, and all teeth 34*a* and 34*b* may be contacting cable 52.

FIG. 3A (as well as FIGS. 7A, 9A, 11A, and 13A) shows how the teeth of each jaw of an IPC are preferably arranged so that the initial cable contact surfaces of the teeth are aligned along an arc, relative to an axis of a cable engaged therebetween. In order to achieve the arc-like alignment, outer rows 36 and 42 have taller teeth than inner rows 36 and 38 (along the z-coordinate direction) such that outer rows 36 and 42 protrude further into an IPC cavity (e.g., cavity 24 of FIG. 1) to engage a larger range of cable diameters. Otherwise stated, the arc-like alignment may be achieved if the teeth in outer rows 36 and 42 have a greater dimension along the z-coordinate than teeth of inner rows 36 and 38.

First jaw 45 includes first set of teeth 34*a* which corresponds to tooth arrangement 34 of FIG. 2A. Moving left-to-right in the x-coordinate direction, the rows of first set of teeth 34*a* on first jaw 45 are arranged as row 36, row 38, row 40, and row 42. Second jaw 48 includes second set of teeth 34*b*, which is arranged to be a reverse mirror orientation first set of teeth 34*a* when the sets of teeth 34*a* and 34*b* are facing each other. Moving left-to-right in the x-coordinate direction, the rows of second set of teeth 34*b* on second jaw 48 are arranged as row 42, row 40, row 38, and row 36.

In FIG. 3B, jaws 45 and 48 are urged together to engage cable 54, which is preferably a cable having a diameter at a lower range of an IPC's range-taking capability. Cable 54 has insulative coating 54A and conductive core 54B. Inner rows of teeth 38 and 40 of each jaw 45 and 48 pierce insulative coating 54A and make an electrical connection with conductive core 54B. As FIG. 3B shows, sets of teeth 34*a* and 34*b* are now closer together. In a non-intermeshing tooth arrangement, outer rows 36 and 42 of first jaw 45 may "crash" into outer rows 42 and 36 of second jaw 48, respectively, because jaws 45 and 48 are now closer to one another. Such a "crashing" of teeth may prevent the teeth on jaws 45 and 48 from contacting conductive core 54B and creating a reliable electrical connection to cable 54. Furthermore, the "crashing" teeth may also prevent the teeth on jaws 45 and 48 from engaging cable 54 with the level of strain relief needed to maintain a mechanical connection with cable 54. However, with intermeshed tooth arrangement 34 of FIG. 2A, outer rows 36 and 42 of first jaw 45 are offset from, and thus intermesh, with outer rows 42 and 36 of second jaw 48, respectively, allowing jaws 45 and 48 to engage small diameter cable 54 securely, with a sufficient force on conductive core 54B to provide a reliable electrical connection. It should also be noted that inner rows 38 and 40 of first jaw 45 may also intermesh with inner rows 38 and 40 of second jaw 48 if a cable smaller than cable 54 is engaged between jaws 45 and 48.

When comparing FIG. 3A to FIG. 3B, it can be seen that as cable diameter increases, the number of rows of teeth in sets of teeth 34*a* and 34*b* contacting the cable may increase. This is also true for the exemplary tooth arrangements described in reference to FIGS. 4A, 5A, 6A, and 8A below. While four inner rows of teeth (38 and 40 of each jaw 45 and 48) contact small diameter cable 54, eight rows of teeth (inner rows 38 and 40 and outer rows 36 and 42 of each jaw 45 and 48) contact large diameter cable 52. The same thing may also be true if more than four rows of teeth are used on jaws 45 and 48. As more teeth contact a cable, the overall current carrying capacity of the teeth increases without excessive Joule heating.

Figure 4A:
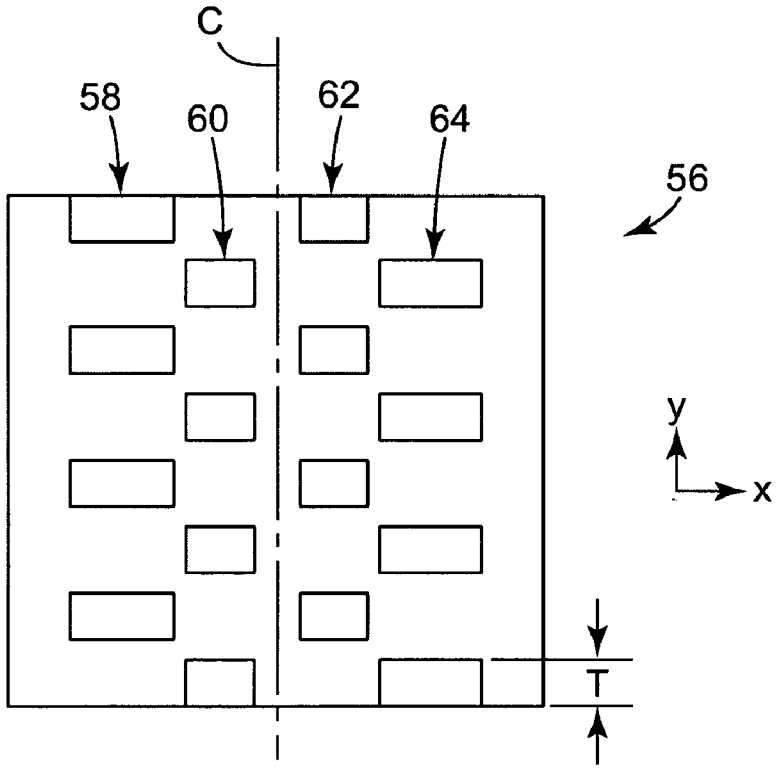
FIG. 4A is a top view diagram of a second exemplary embodiment of a tooth array on an IPC jaw in accordance with the present invention.

FIG. 4A is a top view diagram of a second exemplary embodiment of tooth arrangement 56 on an IPC jaw in accordance with the present invention. Tooth arrangement 56 includes first row 58, second row 60, third row 62, and fourth row 64, where rows 58, 60, 62, and 64 are numbered in the x-coordinate direction. Tooth arrangement may also be arranged so that first row 58 and fourth row 64 switch x-coordinate positions and/or second row 60 and third row 62 switch x-coordinate positions.

Just as with tooth arrangement 34 of FIG. 2A, it is preferred that tooth arrangement 56 on a first IPC jaw and tooth arrangement 56 on a second IPC jaw are reverse mirror images of one another, when the teeth of each jaw are facing each other. Thus, it is preferred that the rows of tooth arrangement 56 on one jaw are arranged as 58, 60, 62, and 64 (moving left-to-right in the x-coordinate direction) and the rows of tooth arrangement 56 on the opposing jaw are arranged as 64, 62, 60, and 58 (moving left-to-right in the x-coordinate direction). As a result, row 58 of the first jaw will oppose row 64 of the second jaw, and row 60 of the first jaw will oppose row 62 of the second jaw, and so forth.

When tooth arrangement 56 is integrated into opposing jaws of an IPC, it is preferred that the IPC have a cable diameter range taking ratio of about 1:6. It is even more preferred that the IPC receive cable diameters ranging from about 0.13 units to about 0.78 units. When a cable having a diameter near the lower end of the range is enclosed between the opposing jaws having tooth arrangement 56 (which for exemplary purposes are assumed to be aligned in both the x and y-coordinate directions along axis C in FIG. 4A), opposing outer rows of teeth 58 and 64 of each jaw do not obstruct one another, but are able to intermesh as necessary. Rather than "crashing" into one another, each tooth in opposing outer rows of teeth 58 and 64 may fit into an opening in the opposing row of teeth.

In an alternate embodiment, tooth arrangements 56 of each IPC jaw may also intermesh if tooth arrangement 56 on the first jaw is a mirror image of tooth arrangement 56 on the second jaw, and the tooth arrangements are offset (by an "offset distance") in the y-coordinate direction from one another in order to allow room for the teeth of each tooth arrangement to intermesh. The offset distance is preferably at least a distance approximately equal to a thickness T (measured in the z-coordinate direction) of a single tooth. Preferably, all teeth in tooth arrangement 56 have a same thickness. However, if all the teeth do not have the same thickness, it is preferred that the offset distance is at least the thickness of the thickest tooth.

Figure 4B:
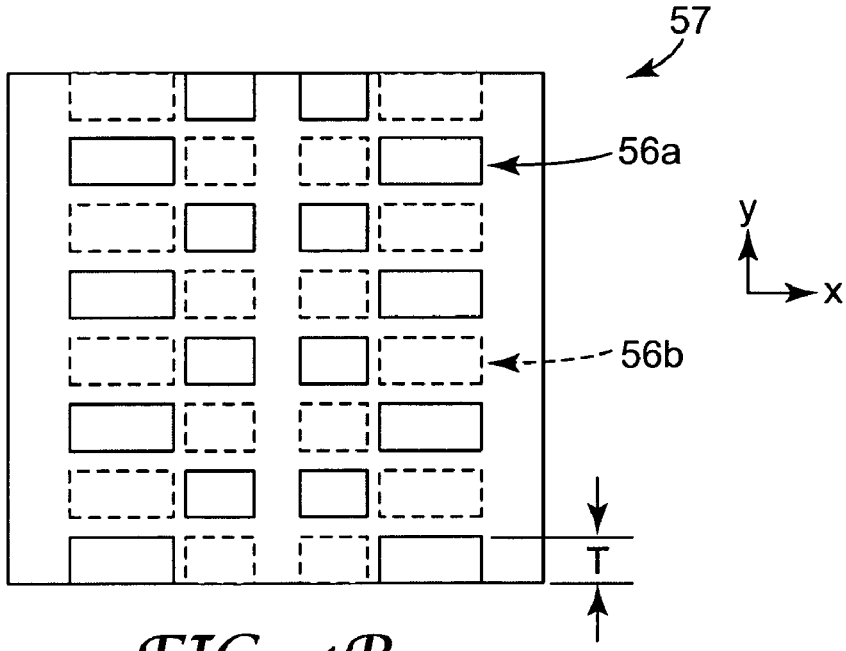
FIG. 4B is a projected top view of an intermeshed tooth arrangement showing how a first set of teeth on a first IPC jaw (shown in solid lines and having the tooth arrangement of FIG. 4A) intermeshes with a second set of teeth on a second, opposed IPC jaw (shown in phantom and having the tooth arrangement of FIG. 4A), where the first and second sets of teeth face each other in a reverse mirror image orientation.

FIG. 4B is a projected top view of intermeshed tooth arrangement 57 showing how first set of teeth 56*a* on a first IPC jaw (shown in solid lines and having tooth arrangement 56 of FIG. 4A) intermeshes with second set of teeth 56*b* on a second, opposing IPC jaw (shown in phantom and having tooth arrangement 56 of FIG. 4A). The first and second sets of teeth are arranged to be reverse mirror images of one another when the teeth of each jaw are facing each other. Teeth of opposing rows 58, 60, 62 and 64 of each jaw are able to intermesh because each tooth "fits" into an opening directly opposing it on the opposing jaw as needed. FIGS. 3A and 3B are illustrative side views of part of an IPC which has incorporated tooth arrangement 56 on opposing jaws.

Figure 5A:
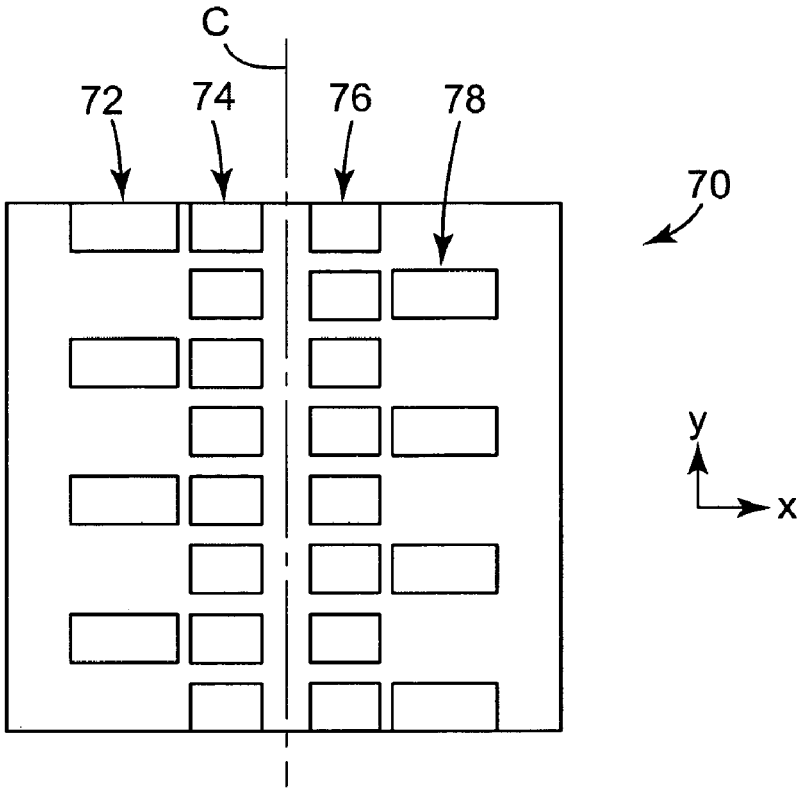
FIG. 5A is a top view diagram of a third exemplary embodiment of a tooth array on an IPC jaw in accordance with the present invention.

FIG. 5A is a top view diagram of a third exemplary embodiment of tooth arrangement 70 in accordance with the present invention. Tooth arrangement 70 includes first row 72, second row 74, third row 76, and fourth row 78, where rows 72, 74, 76, and 78 are numbered in the x-coordinate direction. Tooth arrangement may also be arranged so that first row 72 and fourth row 78 switch x-coordinate positions.

It is preferred that tooth arrangement 70 on a first IPC jaw and tooth arrangement 70 on a second IPC jaw are reverse mirror images of one another, when the teeth of each jaw are facing each other. Thus, it is preferred that the rows of tooth arrangement 70 on one jaw are arranged as 72, 74, 76, and 78 (moving left-to-right in the x-coordinate direction) and the rows of tooth arrangement 70 on the opposing jaw are arranged as 78, 76, 74, and 72 (moving left-to-right in the x-coordinate direction). As a result, row 72 of the first jaw will oppose row 78 of the second jaw, and row 74 of the first jaw will oppose row 76 of the second jaw, and so forth.

When tooth arrangement 70 is integrated into opposing jaws of an IPC, it is preferred that the IPC have a range taking ratio of about 1:6. It is even more preferred that the IPC receive cable diameters ranging from about 0.13 units to about 0.78 units. When a cable having a diameter near the lower end of the range is enclosed between the opposing first jaw and second jaw having tooth arrangement 70 (which for exemplary purposes are assumed to be aligned in both the x and y-coordinate directions along axis C), teeth of opposing outer rows 72 and 78 of each jaw do not obstruct one another, but are able to intermesh as necessary. Rather than "crashing" into one another, each tooth of opposing outer rows 72 and 78 is able to intermesh by fitting into an opening in the opposing row of teeth (as necessary).

Teeth of opposing inner rows of teeth 74 and 76 are not able to intermesh. Preferably, however, inner rows of teeth 74 and 76 are either designed such that they do not "crash" together for cable sizes in the lower end of an IPC's range-taking capability (where tooth arrangement 70 is included in the IPC) or inner rows of teeth 74 and 76 are close enough (in a x-coordinate direction) together such that they will contact all cables having diameters within the IPC's range taking capability.

Figure 5B:
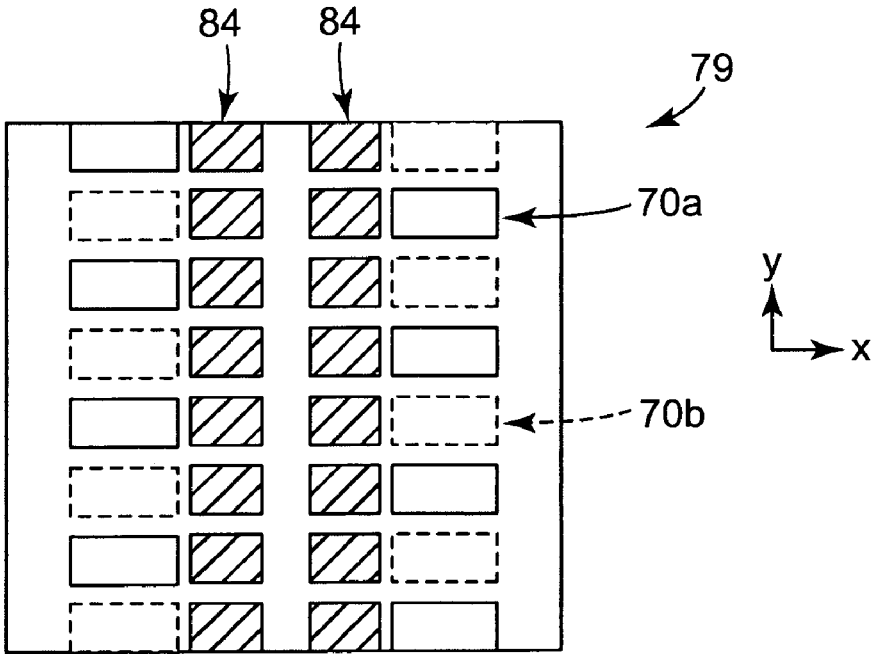
FIG. 5B is a projected top view of an intermeshed tooth arrangement showing how a first set of teeth on a first IPC jaw (shown in solid lines and having the tooth arrangement of FIG. 5A) intermeshes with a second set of teeth on a second, opposed IPC jaw (shown in phantom and having the tooth arrangement of FIG. 5A), where directly opposing teeth that are not able to intermesh are shown by cross-hatching, and where the first and second sets of teeth face each other in a reverse mirror image orientation.

FIG. 5B is a projected top view of intermeshed tooth arrangement 79 showing how first set of teeth 70*a* on a first IPC jaw (shown in solid lines and having tooth arrangement 70 of FIG. 5A) intermeshes with second set of teeth 70*b* on a second IPC jaw (shown in phantom and having tooth arrangement 70 of FIG. 5A). The arrangements of first and second sets of teeth 70*a* and 70*b* are reverse mirror images of one another when facing each other and are aligned in x and y-coordinate directions along axis C (see FIG. 5A). Crosshatched boxes 84 represent inner rows of teeth 74 and 76 of on each opposing IPC jaw, which are not able to intermesh and are directly opposing one another. When a cable having a diameter in a lower range of the IPC's range-taking capability is engaged between the first and second jaws, inner rows of teeth 74 and 76 contact the cable while outer rows 72 and 78 of each jaw intermesh as necessary. An IPC which has incorporated tooth arrangement 70 on its moveable jaw and on its fixed jaw has a side view similar to that of FIGS. 3A and 3B when engaged with a cable.

Tooth arrangement 70 may more evenly distribute a given force on small diameter cable sizes without damaging the inner conductive cores of the cables. A given installation torque provides a given force between the teeth and cable. With tooth arrangement 70, the overall pressure on each tooth is smaller than with tooth arrangements 34 and 56, which may create less damage to a conductive core of a cable over time. With tooth arrangements 34, 56, and 70, a single installation torque may be used, which may simplify installation techniques.

Figure 6A:
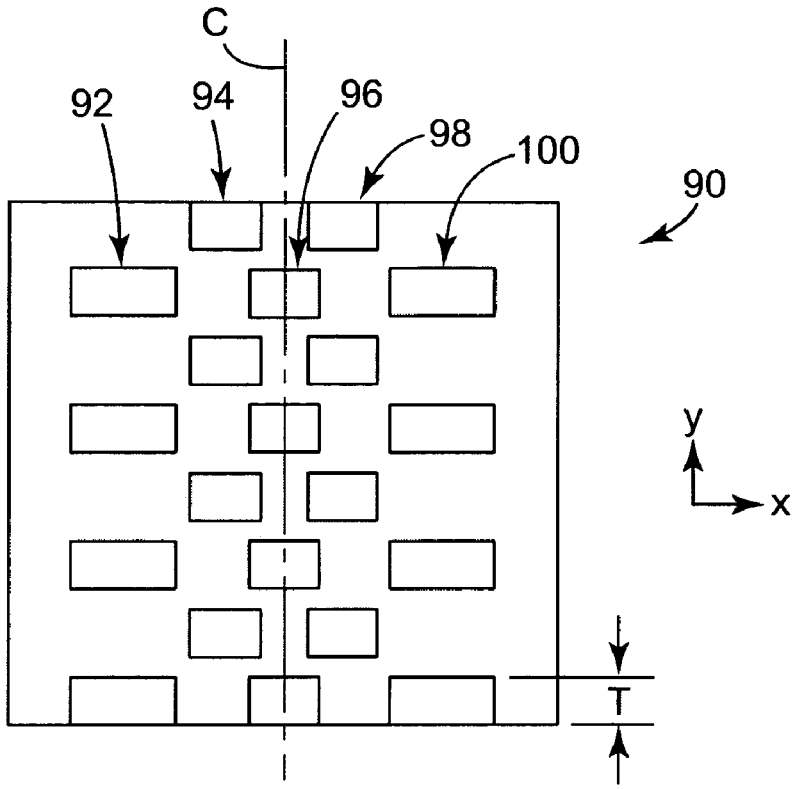
FIG. 6A is a top view diagram of a fourth exemplary embodiment of a tooth array on an IPC jaw in accordance with the present invention.

FIG. 6A is a top view diagram of a fourth exemplary embodiment of tooth arrangement 90 in accordance with the present invention. Tooth arrangement 90 includes first row 92, second row 94, third row 96, fourth row 98, and fifth row 100 where rows 92, 94, 96, 98, and 100 are numbered in the x-coordinate direction. It is preferred that tooth arrangement 90 on a first IPC jaw and tooth arrangement 90 on a second IPC jaw are reverse mirror images of one another when the teeth of each jaw are facing each other and aligned in both the x and y-coordinate directions along axis C. Tooth arrangement 90 on one jaw is arranged as 92,94, 96, 98, and 100 (moving left-to-right in the x-coordinate direction) and tooth arrangement 90 on the opposing jaw is arranged as 100, 98, 96, 94, and 92 (moving left-to-right in the x-coordinate direction). Otherwise stated, it is preferred that row 92 of the first jaw opposes row 100 of the second jaw, that row 94 of the first jaw opposes row 98 of the second jaw, and so forth. Rather than "crashing" into one another, each tooth in rows 92, 94, 98, and 100 of the first jaw is able to fit into an opening in the opposing row of teeth (as necessary), thereby intermeshing.

In an alternate embodiment, intermeshing is possible if tooth arrangement 90 of the first jaw is a mirror image of (when the teeth of each jaw are facing each other) and offset a distance T from tooth arrangement 90 of the second jaw. The distance T is approximately equal to a thickness (measured in a y-direction) of a single tooth. Preferably, all teeth in tooth arrangement 90 have a same thickness. However, if all the teeth do not have the same thickness, it is preferred that the offset distance is at least the thickness of the thickest tooth. The offsetting of the two opposing tooth arrangements 90 allow intermeshing because the teeth of one jaw fits into an opening in the teeth of an opposing jaw.

Figure 6B:
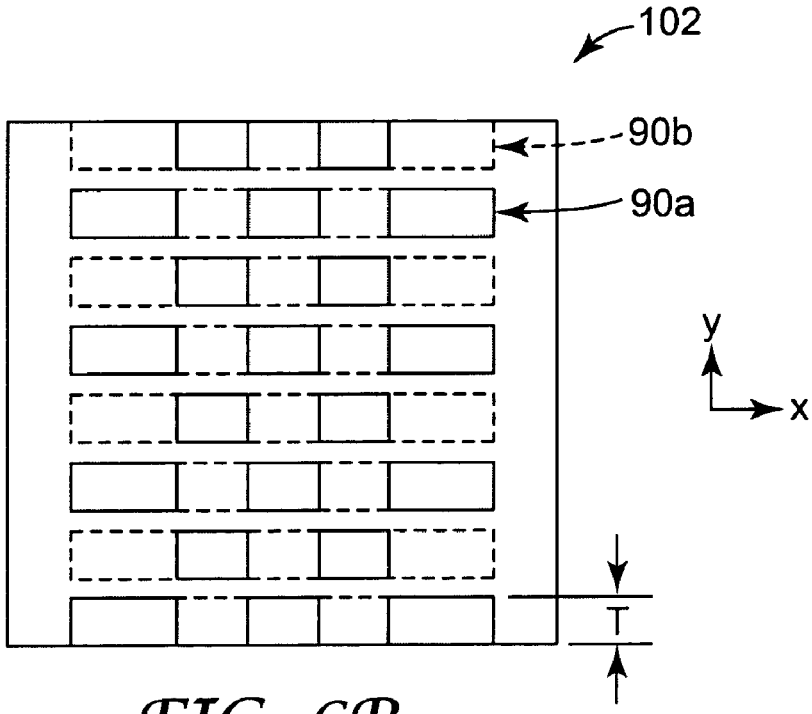
FIG. 6B is a projected top view of an intermeshed tooth arrangement showing how a first set of teeth on a first IPC jaw (shown in solid lines and having the tooth arrangement of FIG. 6A) intermeshes with a second set of teeth on a second, opposed IPC jaw (shown in phantom and having the tooth arrangement of FIG. 6A), where the first and second sets of teeth face each other in a reverse mirror image orientation.

FIG. 6B is a projected top view of intermeshed tooth arrangement 102 showing how first set of teeth 90*a* of a first IPC jaw (shown in solid lines and having tooth arrangement 90 of FIG. 6A) intermeshes with second set of teeth 90*b* (shown in phantom and having tooth arrangement 90 of FIG. 6A), where the tooth arrangements of each jaw are reverse mirror images of one another.

Figure 7A:
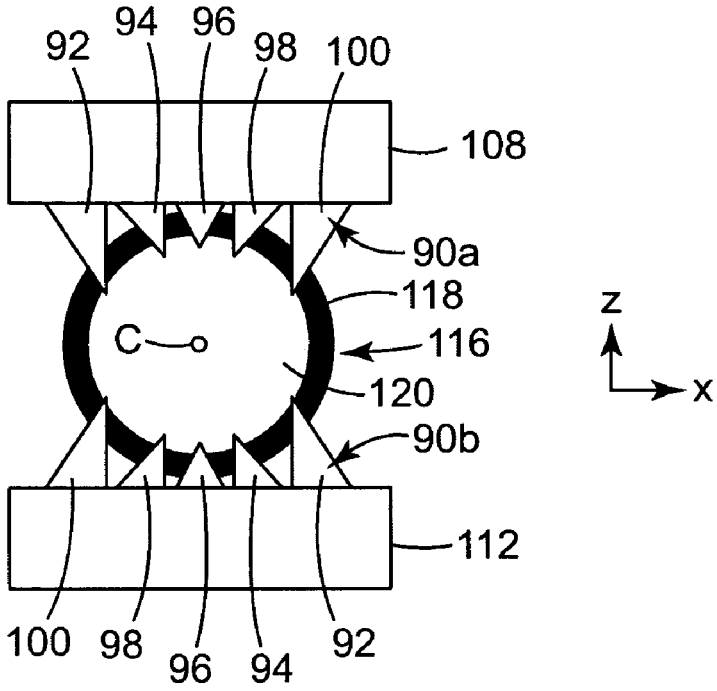
FIG. 7A is side view of a first IPC jaw and a second IPC jaw incorporating the tooth arrangement of FIG. 6A, as urged into an insulation-piercing and conductive relation relative to a cable having a first diameter.
Figure 7B:
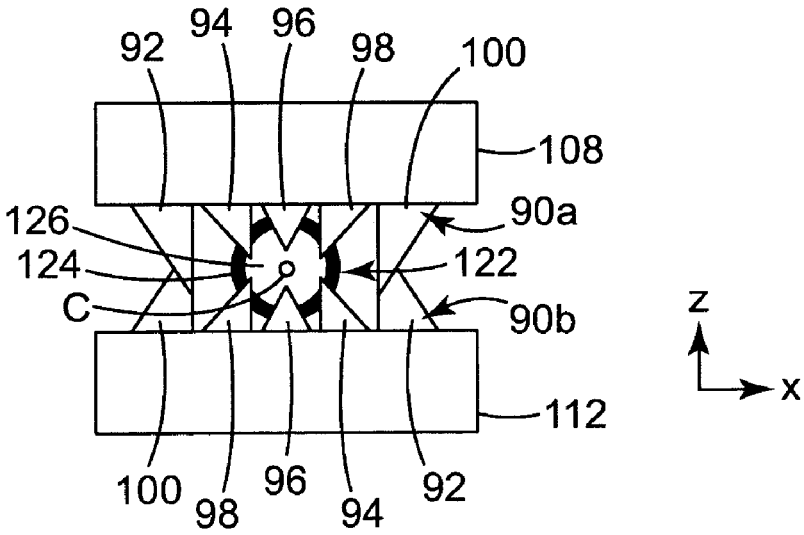
FIG. 7B is a side view like FIG. 7A, showing the inventive tooth arrangement of FIG. 6A urged into an insulation-piercing and conductive relation relative to a cable having a second, smaller diameter than the cable in FIG. 7A.

FIG. 7A is a side view of first IPC jaw 108 having first set of teeth 90*a*, second IPC jaw 112 having second set of teeth 90*b*, and cable 116. FIGS. 7A and 7B are used to show how tooth configuration 90 may be incorporated into opposing jaws 108 and 112, and present side views of how sets of teeth 90*a* and 90*b* may intermesh. First and second sets of teeth 90*a* and 90*b* are each arranged in tooth arrangement 90 of FIG. 6A, and are arranged to be reverse mirror images of one another when the sets of teeth 90*a* and 90*b* are facing each other and aligned in both x and y-coordinate directions along axis C. Moving left-to-right in the x-coordinate direction, the rows of first set of teeth 90*a* on first jaw 108 are arranged as rows 92, 94, 96, 98, and 100. Moving left-to-right in the x-coordinate direction, the rows of second set of teeth 90*b* on second jaw 112 are arranged as rows 100, 98, 96, 94, and 92.

In FIG. 7A, first jaw 108 and second jaw 112 are urged together to engage cable 116. Cable 116 includes insulative layer 118 and conductive core 120. Cable is 116 is preferably a cable having a diameter at a higher end of an IPC's range taking capability. Teeth 90*a* and 90*b* pierce insulative layer 118 of cable 116 and make an electrical connection with conductive core 120. As FIG. 7A shows, teeth 90*a* and 90*b* may not obstruct one another when engaged with a large diameter cable 116 because jaws 108 and 112 may not move close enough to one another for teeth 90*a* and 90*b* to touch, and all teeth 90*a* and 112 may be contacting cable 116.

In FIG. 7B, jaws 108 and 112 are urged together to engage cable 122, which is preferably a cable having a diameter at a lower range of an IPC's range-taking capability. Preferably, cable 122 has a smaller diameter than cable 116. Cable 122 has insulative coating 124 and conductive core 126. Inner rows of teeth 94,96, and 98 pierce insulative coating 124 and make an electrical contact with conductive core 126. In a nonintermeshing tooth arrangement, opposing outer rows 92 and 100 of each jaw 108 and 112 may obstruct one another as first jaw 108 is moved towards second jaw 112 because cable 122 is too small to contact outer rows 92 and 100. However, with intermeshed tooth arrangement 90, the teeth of opposing outer rows 92 and 100 do not obstruct one another. Outer rows 92 and 100 of first jaw 108 are offset from and thus intermesh with outer rows 92 and 100 of second jaw 112. If a cable having a diameter smaller than the diameter of cable 122 is used, only row 96 of each jaw 108 and 112 may contact the cable, and opposing rows 92, 94, 98, and 100 may intermesh.

Figure 8A:
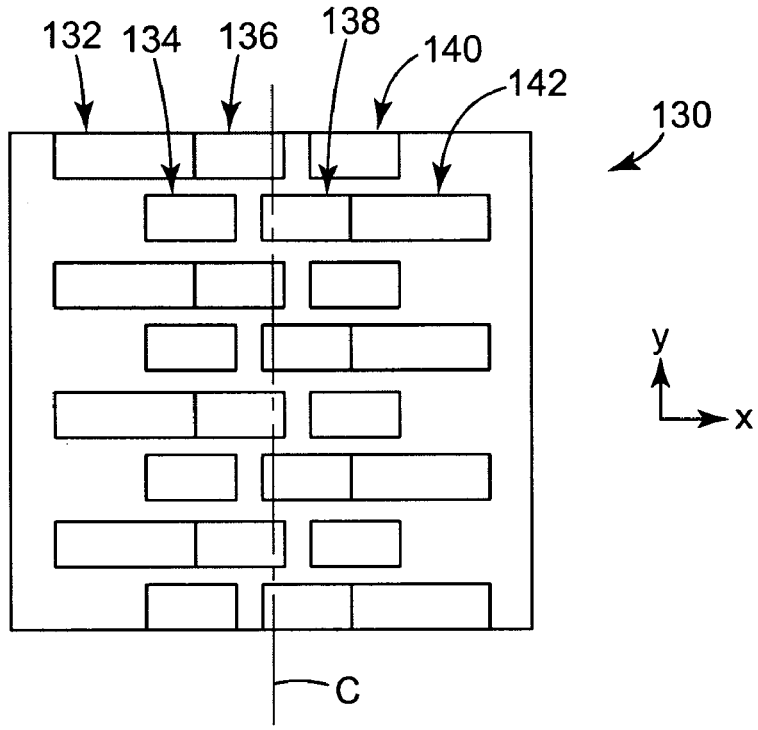
FIG. 8A is a top view diagram of a fifth exemplary embodiment of a tooth array on an IPC jaw in accordance with the present invention.

FIG. 8A is a top view diagram of a fifth exemplary embodiment of tooth arrangement 130 in accordance with the present invention. Tooth arrangement 130 includes first row 132, second row 134, third row 136, fourth row 138, fifth row 140, and sixth row 142 where rows 132, 134, 136, 138, 140, and 142 are numbered in the x-coordinate direction. Rather than positioning tooth arrangement 130 on a first IPC jaw to be a mirror image of tooth arrangement 130 on a second IPC jaw, it is preferred that tooth arrangement 130 on the first jaw is arranged to be a reverse mirror image of tooth arrangement 130 on the second jaw. That is, preferably, tooth arrangement 130 on the first jaw is arranged as 132, 134, 136, 138, 140, and 142 (moving left-to-right in the x-coordinate direction) and tooth arrangement 130 on the opposing jaw is arranged as 142, 140, 138, 136, 134, and 132 (moving left-to-right in the x-coordinate direction). As a result, row 132 of the first IPC jaw opposes row 142 of the second jaw, and row 134 of the first jaw opposes row 140 of the second jaw, and so forth.

The reverse mirror orientation of one tooth arrangement 130 relative to another allows each tooth from row 132 and row 142 of opposing jaws to partially intermesh, where a part of each tooth from row 132 and row 142 of the first jaw fit into an opening in row 132 and row 142 of the second jaw, respectively. This can be seen more clearly in FIG. 8B.

Figure 8B:
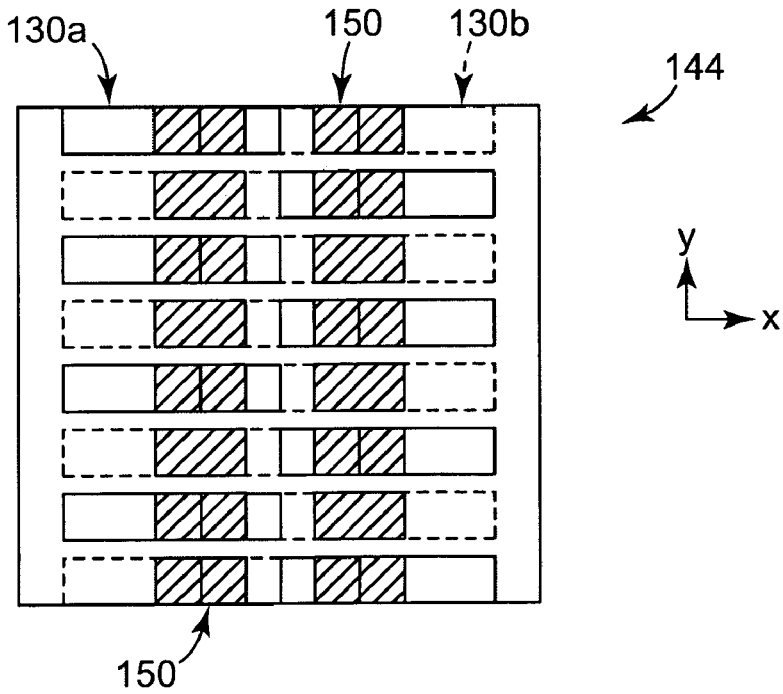
FIG. 8B is a projected top view of an intermeshed tooth arrangement showing how a first set of teeth on a first IPC jaw (shown in solid lines and having the tooth arrangement of FIG. 8A) intermeshes with a second set of teeth on a second, opposed IPC jaw (shown in phantom and having the tooth arrangement of FIG. 8A), where directly opposing teeth that are not able to intermesh are shown by cross-hatching, and where the first and second sets of teeth face each other in a reverse mirror image orientation.
Figure 9A:
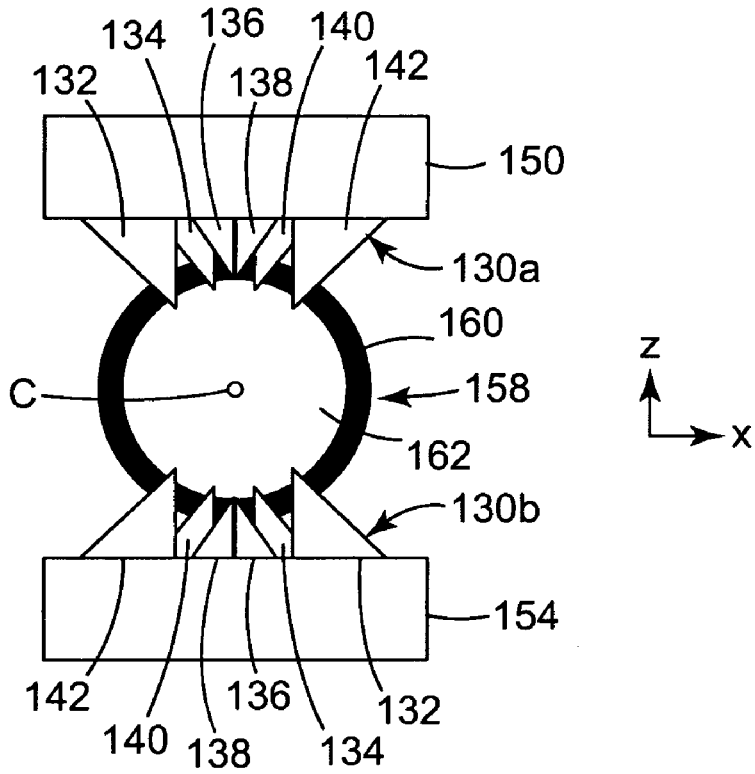
FIG. 9A is side view of a first IPC jaw and a second IPC jaw incorporating the tooth arrangement of FIG. 8A, as urged into an insulation-piercing and conductive relation relative to a cable having a first diameter.

FIG. 8B is a projected top view of intermeshed tooth arrangement 144 showing how first set of teeth 130*a* of a first IPC jaw (shown in solid lines and having tooth arrangement 130 of FIG. 8A) intermeshes with second set of teeth 130*b* of a second IPC jaw (shown in phantom and having tooth arrangement 130 of FIG. 8A), where tooth arrangement of the first and second sets of teeth are reverse mirror images of one another. Crosshatched boxes 150 represent areas where teeth from first set of teeth 130*a* directly oppose teeth from second set of teeth 130*b*, and are not able to intermesh. As FIG. 8B shows, part of row 132 of first set of teeth 130*a* is in direct opposition with row 140 of second set of teeth 130*b*. However, if row 140 has shorter teeth than row 132 (as shown in FIG. 9A), row 132 and row 140 may not obstruct one another when the first and second jaws are engaging a cable. The same applies to row 142 of first set of teeth 130*a* and row 134 of second set of teeth 130*b*, which also do not completely intermesh.

Figure 9B:
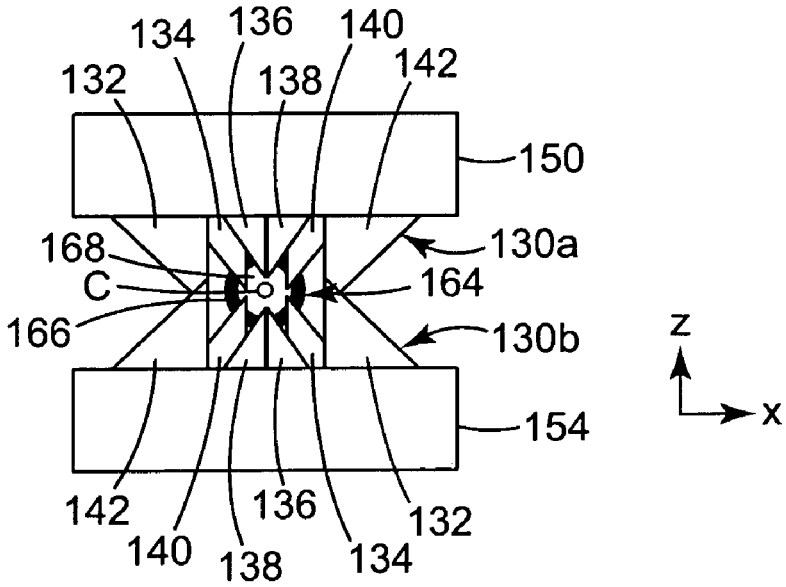
FIG. 9B is a side view like FIG. 9A, showing the inventive tooth arrangement of FIG. 8A urged into an insulation-piercing and conductive relation relative to a cable having a second, smaller diameter than the cable in FIG. 9A.

FIG. 9A is a side view of first IPC jaw 150 having first set of teeth 130*a*, second IPC jaw 154 having second set of teeth 130*b*, and cable 158. FIGS. 9A and 9B are used to show how tooth configuration 130 may be incorporated into opposing jaws 150 and 154, and present side views of how sets of teeth 130*a* and 130*b* may intermesh. First and second sets of teeth 130*a* and 130*b* are each arranged in tooth arrangement 130 of FIG. 8A, where the tooth arrangements are reverse mirror images of one another when the sets of teeth 130*a* and 130*b* are facing each other and aligned in x and y-coordinate directions along axis C. Moving left-to-right in the x-coordinate direction, the rows of first set of teeth 130*a* on first jaw 150 are arranged as rows 132, 134, 136, 138, 140, and 142. Moving left-to-right in the x-coordinate direction, the rows of second set of teeth 130*b* on second jaw 154 are arranged as rows 142, 140, 138, 136, 134, and 132.

In FIG. 9A, first jaw 150 and second jaw 154 are urged together to engage cable 158. Cable 158 includes insulative layer 160 and conductive core 162. Cable is 158 is preferably a cable having a diameter at a higher end of an IPC's range taking capability. Sets of teeth 130*a* and 130*b* pierce insulative layer 160 of cable 158 and make an electrical connection with conductive core 162. With a large diameter cable 158, "crashing" teeth may not be a concern because jaws 150 and 154 may not move close enough to one another for opposed teeth in sets of teeth 130*a* and 130*b* to touch, and all teeth in sets of teeth 130*a* and 130*b* may be contacting cable 158.

In FIG. 9B, jaws 150 and 154 are urged together to engage cable 164, which is preferably a cable having a diameter at a lower range of an IPC's range-taking capability. Cable 164 preferably has a smaller diameter than cable 158. Cable 164 has insulative coating 166 and conductive core 168. Inner rows 134, 136, 138, and 140 of teeth on first and second jaws 150 and 154 pierce insulative coating 166 and make an electrical contact with conductive core 168. In a nonintermeshing tooth arrangement, the teeth of opposing outer rows 132 and 142 of each jaw 150 and 154 may obstruct one another when first jaw 150 is moved towards second jaw 154 because cable 164 may be too small to contact outer rows 132 and 142. However, with intermeshed tooth arrangement 130, the teeth of opposing outer rows 132 and 142 do not obstruct one another. Rather than "crashing" into one another, the teeth of opposing outer rows 132 and 142 are offset from one another, thus allowing intermeshing because teeth of row 132 on first jaw 150 are able to partially fit into openings in row 142 of second jaw 154. If a cable having a diameter smaller than the diameter of cable 158 is used, only rows 136 and 138 may contact the cable, and opposing rows 132, 134, 140, and 142 may partially intermesh.

Figure 10A:
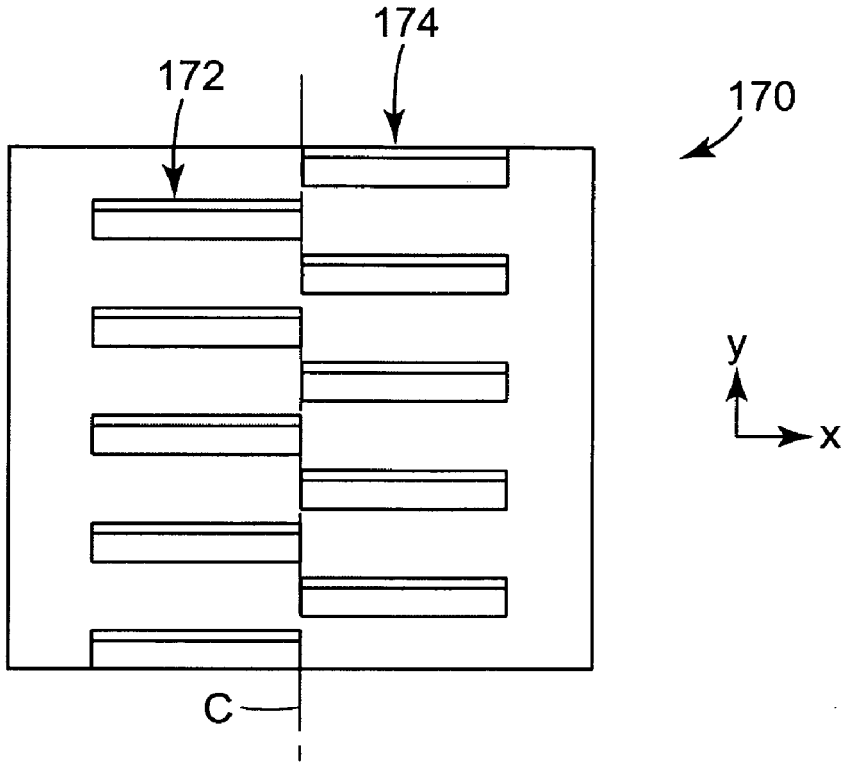
FIG. 10A is a top view diagram of a sixth exemplary embodiment of a tooth array on an IPC jaw in accordance with the present invention.

FIG. 10A is a top view diagram of a sixth exemplary embodiment of tooth arrangement 170 in accordance with the present invention. Tooth arrangement 170 includes first row 172 and second row 174 of teeth, where rows 172 and 174 are numbered in the x-coordinate direction. It is preferred that each tooth in tooth arrangement 170 be substantially similar in size and shape. Preferably, tooth arrangement 170 on a first IPC jaw is a reverse mirror image of tooth arrangement 170 on a second IPC jaw, when the teeth of each IPC jaw are facing one another and aligned in both x and y-coordinate directions along axis C. It is preferred that row 172 of the first jaw opposes row 174 of the second jaw, and row 174 of the first jaw opposes row 172 of the second jaw. The reverse mirror image allows the teeth of the first and second IPC jaws to intermesh because the teeth of row 172 of the first jaw are able to fit into an opening in row 174 of the second jaw, and the teeth of row 174 of the first jaw are able to fit into an opening in row 172 of the second jaw. The intermeshing can be seen more clearly in FIG. 10B.

Figure 10B:
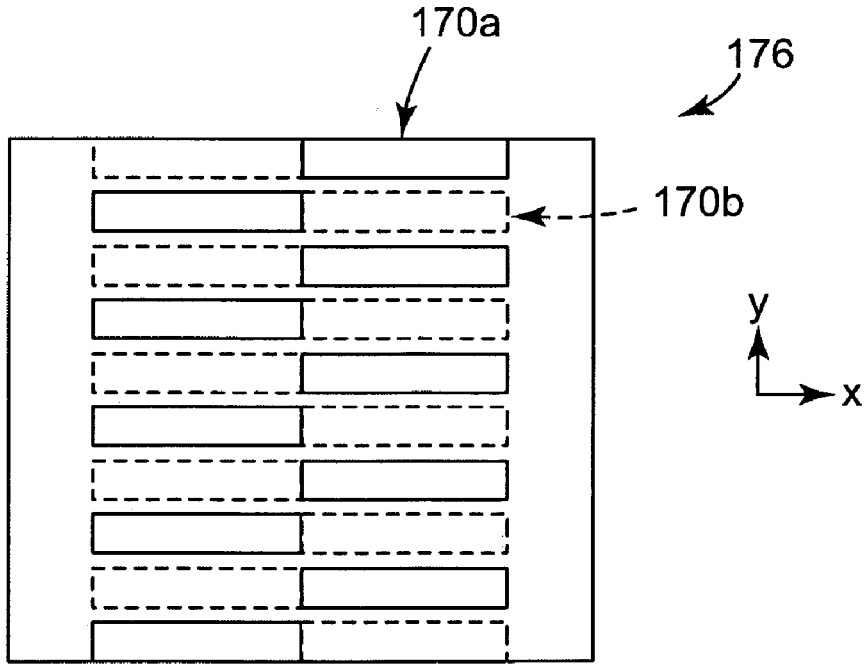
FIG. 10B is a projected top view of an intermeshed tooth arrangement showing how a first set of teeth on a first IPC jaw (shown in solid lines and having the tooth arrangement of FIG. 10A) intermeshes with a second set of teeth on a second, opposed IPC jaw (shown in phantom and having the tooth arrangement of FIG. 10A), where the first and second sets of teeth face each other in a reverse mirror image orientation.

FIG. 10B is a projected top view of intermeshed tooth arrangement 176 showing how first set of teeth 170*a* having on a first jaw (shown in solid lines and having tooth arrangement 170 of FIG. 10A) intermeshes with second set of teeth 170*b* on a second jaw (shown in phantom and having tooth arrangement 170 of FIG. 10A), where the tooth arrangements of first and second sets of teeth 170*a* and 170*b* are reverse mirror images of one another. As FIG. 10B shows, first and second sets of teeth 170*a* and 170*b* are able to intermesh as necessary because each tooth in row 172 of first set of teeth 170*a* fits into an opening in row 174 of second set of teeth 170*b*, and each tooth in row 174 of first set of teeth 170*a* fits into an opening in row 172 of second set of teeth 170*b*.

Figure 11A:
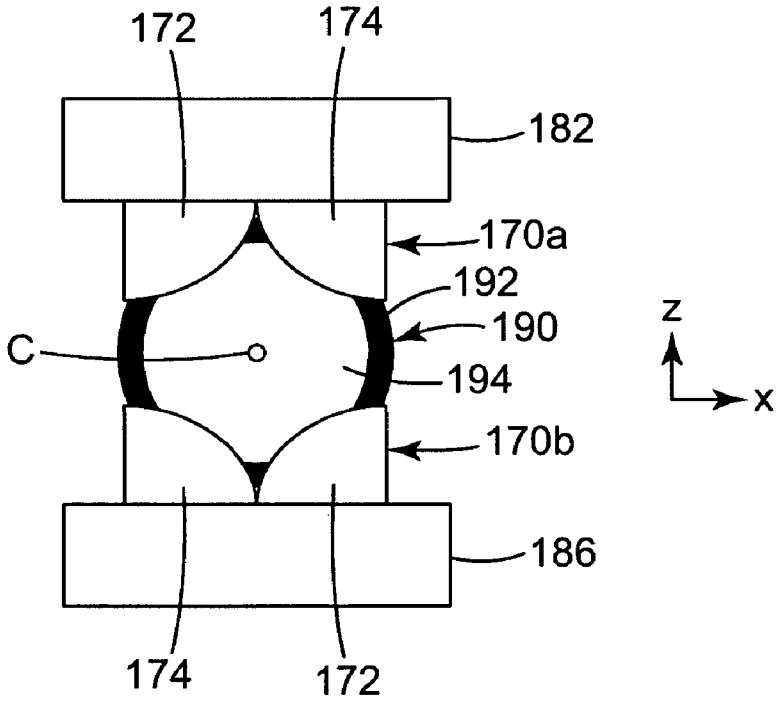
FIG. 11A is side view of a first IPC jaw and a second IPC jaw incorporating the tooth arrangement of FIG. 10A as urged into an insulation-piercing and conductive relation relative to a cable having a first diameter.
Figure 11B:
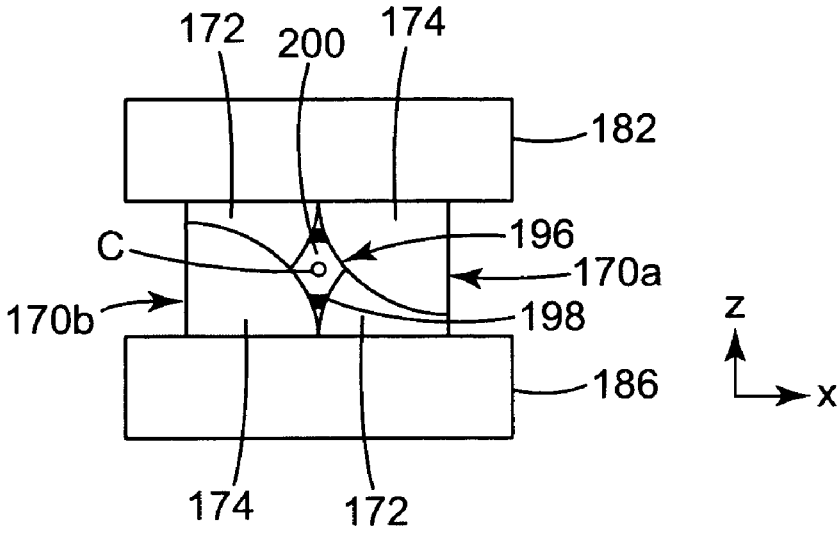
FIG. 11B is a side view like FIG. 11A, showing the inventive tooth arrangement of FIG. 10A urged into an insulation-piercing and conductive relation relative to a cable having a second, smaller diameter than the cable in FIG. 11A.

FIG. 11A is a side view of first jaw 182 having first set of teeth 170*a*, second jaw 186 having second set of teeth 170*b*, and cable 190. FIGS. 11A and 11B are used to show how tooth configuration 170 may be incorporated into opposing jaws 182 and 186, and present side views of how sets of teeth 170*a* and 170*b* may intermesh. First and second set of teeth 170*a* and 170*b* are each arranged in tooth arrangement 170. Preferably, each tooth of first and second set 170*a* and 170*b* have a curved, blade-like shape, as shown in FIG. 11A, or equivalents thereof. First and second set of teeth 170*a* and 170*b* are each arranged in tooth arrangement 170 of FIG. 10A, where the tooth arrangements are reverse mirror images of one another (when the sets of teeth 170*a* and 170*b* are facing each other). Moving left-to-right in the x-coordinate direction, the rows of first set of teeth 170*a* on first jaw 170*a* are arranged as rows 172 and 174, while the rows of second set of teeth 170*b* on second jaw 186 are arranged as rows 174 and 172.

In FIG. 11A, first jaw 182 and second jaw 186 are urged together to engage cable 190. Cable 190 includes insulative layer 192 and conductive core 194. Cable is 190 is preferably a cable having a diameter at a higher end of an IPC's range taking capability. First and second set of teeth 170*a* and 170*b* pierce insulative layer 192 of cable 190 and make an electrical connection with conductive core 194. As FIG. 11A shows, first and second sets of teeth 170*a* and 170*b* may not obstruct one another when engaged with a large diameter cable 190 because jaws 182 and 186 may not move close enough together for teeth 170*a* and 170*b* to touch, and all teeth in first and second sets of teeth 170*a* and 170*b* are in contact with cable 190.

In FIG. 11B, jaws 182 and 186 are urged together to engage cable 196, which is preferably a cable having a diameter at a lower range of an IPC's range-taking capability and has a smaller diameter than cable 190. Cable 196 has insulative coating 198 and conductive core 200. All of first and second set of teeth 170*a* and 170*b* pierce insulative coating 198 of cable 196 and make an electrical connection with conductive core 200. In a nonintermeshing tooth arrangement, opposing rows 172 and 174 of each jaw 182 and 186 may obstruct one another as first jaw 182 moves towards second jaw 186. However, when the tooth arrangements 170 on each jaw are arranged to be reverse mirror images of one another, the teeth of opposing rows 172 and 174 of each jaw 182 and 186 are offset from one another, and thus intermesh, even with smaller cable sizes.

In contrast to the first through fifth exemplary embodiments described above, the number of teeth of tooth configuration 170 of FIG. 10A contacting a cable remains constant for all cable sizes in an IPC's cable diameter range taking capability. This is due to the blade-like shape of each tooth as well as the intermeshing configuration. Preferably, a "blade-like" shape indicates that a tooth's initial cable contact surface gets shorter (relative to its respective jaw) as it approaches a plane in the z-coordinate direction that includes axis C. "Shorter" indicates a smaller dimension along the z-coordinate. Although the same number of teeth contact all cable sizes, the interfacial contact area per tooth increases as the cable size increases, thus allowing the teeth to increase their current carrying capacity for large diameter cables.

Figure 12A:
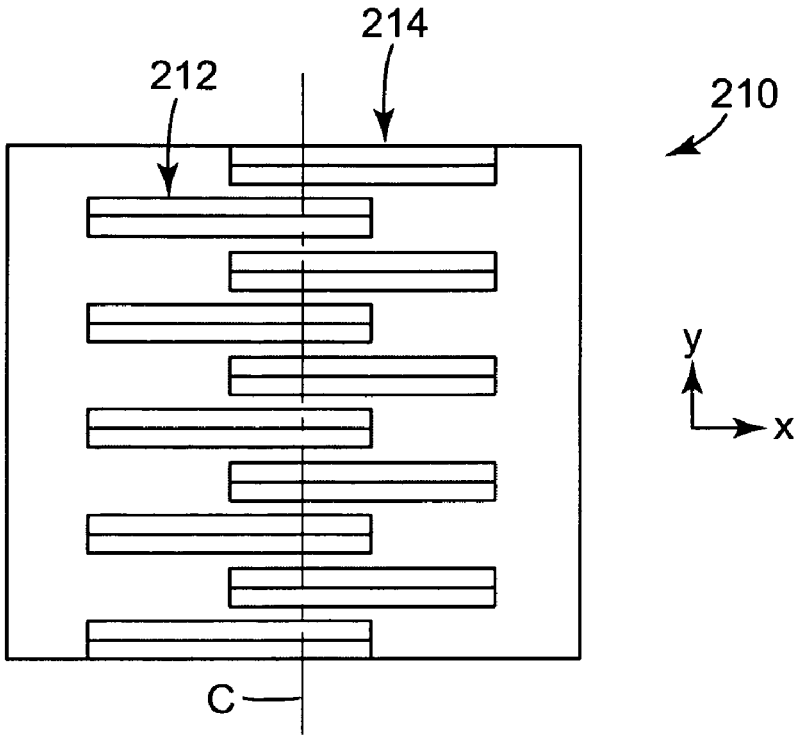
FIG. 12A is a top view diagram of a seventh exemplary embodiment of a tooth array on an IPC jaw in accordance with the present invention.

FIG. 12A is a top view diagram of a seventh exemplary embodiment of tooth arrangement 210 in accordance with the present invention. Tooth arrangement 210 includes first row 212 and second row 214 of teeth, where rows 212 and 214 are numbered in the x-coordinate direction. It is preferred that each tooth in tooth arrangement 210 be substantially similar in size and shape. It is preferred that tooth arrangement 210 on a first jaw is a reverse mirror image of tooth arrangement 210 on a second, opposing jaw when the teeth are facing each other. Each tooth from row 212 of the first jaw is able to partially intermesh with row 214 of the second jaw by partially fitting into an opening in row 214. Similarly, each tooth from row 214 of the first jaw is able to partially intermesh with row 212 of the second jaw by partially fitting into an opening in row 212. This is seen more clearly in FIG. 12B.

Figure 12B:
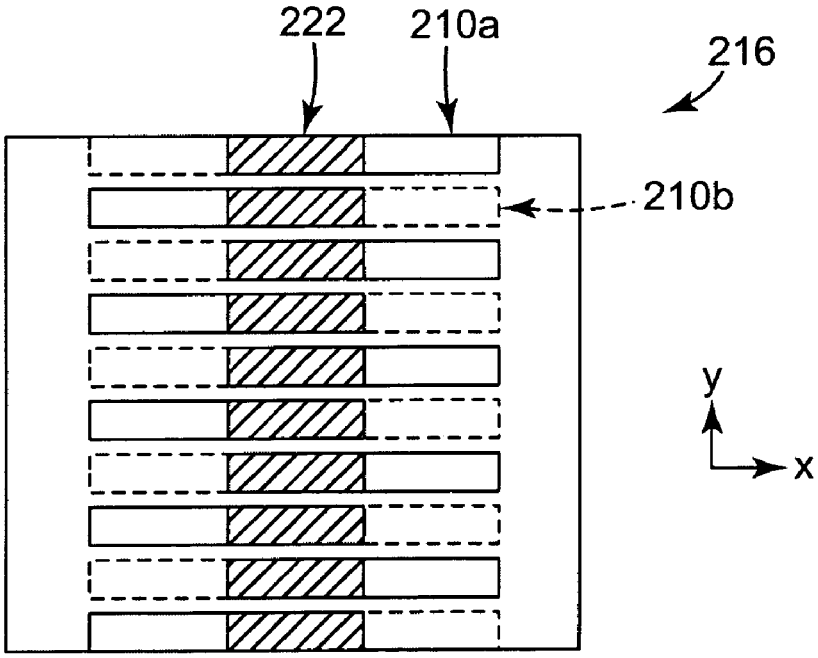
FIG. 12B is a projected top view of an intermeshed tooth arrangement showing how a first set of teeth on a first IPC jaw (shown in solid lines and having the tooth arrangement of FIG. 12A) intermeshes with a second set of teeth on a second, opposed IPC jaw (shown in phantom and having the tooth arrangement of FIG. 12A), where directly opposing teeth that are not able to intermesh are shown by cross-hatching, and where the first and second sets of teeth face each other in a reverse mirror image orientation.

FIG. 12B is a projected top view of intermeshed tooth arrangement 216 showing how first set of teeth 210*a* on a first IPC jaw (shown in solid lines and having tooth arrangement 210 of FIG. 12A) intermeshes with second set of teeth 210*b* on a second, opposing IPC jaw (shown in phantom and having tooth arrangement 210 of FIG. 12A), where the tooth arrangements of first and second sets of teeth 210*a* and 210*b* are reverse mirror images of one another. Crosshatched boxes 222 represent areas where the teeth from first set of teeth 210*a* are not able to intermesh with the teeth from second set of teeth 210*b*. As FIG. 12B shows, part of row 212 of first set of teeth 210*a* is partially in direct opposition with a part of row 214 of second set of teeth 210*b*. However, this partial direct opposition may not be a hindrance to the IPC's cable diameter range-taking capability if each tooth in tooth arrangement 210 has a blade-like configuration. Thus, it is preferred that each tooth in tooth arrangement 210 have a blade-like configuration. Even more preferred is that a cable engagement edge of each tooth has an angled face (such as the hypotenuse of a right triangle), where a tallest tip of each tooth engagement edge is furthest from the C axis in the x-coordinate direction. A blade-like shape may enable a part of each tooth from each jaw to intermesh so that they do not obstruct one another when the first and seconds jaws are engaging a cable.

Figure 13A:
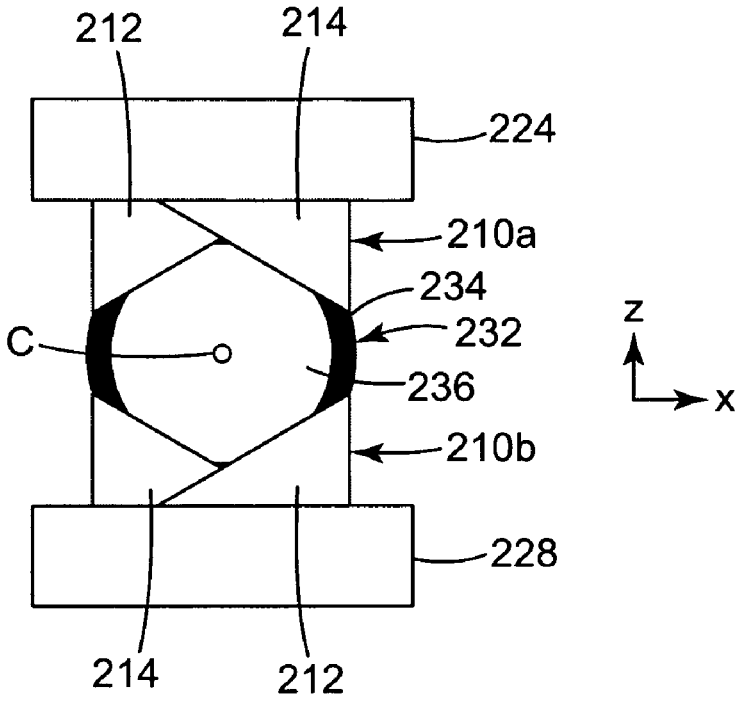
FIG. 13A is side view of a first IPC jaw and a second IPC jaw incorporating the tooth arrangement of FIG. 12A, as urged into an insulation-piercing and conductive relation relative to a cable having a first diameter.
Figure 13B:
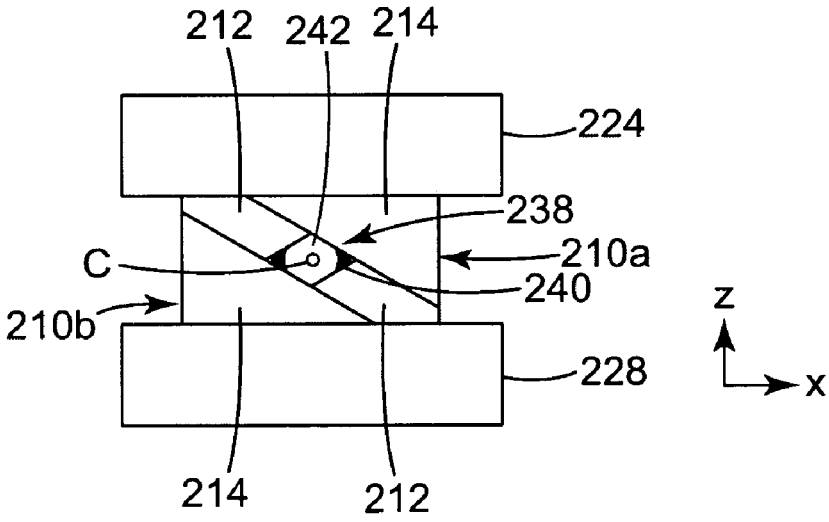
FIG. 13B is a side view like FIG. 13A, showing the inventive tooth arrangement of FIG. 12A urged into an insulation-piercing and conductive relation relative to a cable having a second, smaller diameter than the cable in FIG. 13A.

FIG. 13A is a side view of first jaw 224 having first set of teeth 210*a*, second jaw 228 having second set of teeth 210*b*, and cable 232. FIGS. 13A and 13B are used to show how tooth configuration 210 may be incorporated into opposing jaws 224 and 228, and present side views of how the teeth may intermesh. First jaw 224 and second jaw 228 may be a moveable jaw and fixed jaw, respectively, of an IPC. First and second set of teeth 210*a* and 210*b* are each arranged in tooth arrangement 210, where the tooth arrangements are reverse mirror images of one another (when the sets of teeth 210*a* and 210*b* are facing each other and aligned along both x and y-coordinate directions relative to axis C). Moving left-to-right in the x-coordinate direction, the rows of teeth in first set of teeth 210*a* of first jaw 224 are arranged as rows 212 and 214. Moving left-to-right in the x-coordinate direction, the rows of teeth in second set of teeth 210*b* of second jaw 228 are arranged as rows 214 and 212. Preferably, each tooth of first and second set 210*a* and 210*b* have a blade-like shape, as shown in FIG. 11A or 13A, or equivalents thereof.

In FIG. 13A, jaws 224 and 228 are urged together to engage cable 232. Cable 232 includes insulative layer 234 and conductive core 236. First and second set of teeth 210*a* and 210*b* pierce insulative layer 234 of cable 232 and make an electrical connection with conductive core 236. Cable is 232 is preferably a cable having a diameter at a higher end of an IPC's range taking capability. As FIG. 13A shows, first and second sets of teeth 210*a* and 210*b* may not obstruct one another when engaged with a large diameter cable 232 because jaws 224 and 228 may not move close enough to one another for sets of teeth 210*a* and 210*b* to touch, and all teeth in first and second sets of teeth 210*a* and 210*b* may contact cable 232.

In FIG. 13B, jaws 224 and 228 are urged together to engage cable 238, which is preferably a cable having a diameter at a lower range of an IPC's range-taking capability, and has a smaller diameter than cable 232. Cable 238 includes insulative coating 240 and conductive core 242. Rows 212 and 214 of first and second sets of teeth 210*a* and 210*b* pierce insulative coating 240 of cable 238 and make an electrical connection with conductive core 242. The teeth of opposing rows 212 and 214 of each jaw 224 and 228 partially intermesh, even with smaller cable sizes, because the blade-like configuration of each tooth allows at least part of each tooth to intermesh with an opposing tooth. Similar to tooth arrangement 170 of FIG. 10A, the number of teeth of tooth configuration 210 of FIG. 12A contacting a cable remains constant for all cable sizes in an IPC's range taking capability. This is due to the blade-like shape of each tooth, as well as the intermeshing configuration. Although the same number of teeth contact all cable sizes, the interfacial contact area per tooth increases as the cable size increases, thus allowing the teeth to increase their current carrying capacity for larger diameter cables.

Although the present invention has been described with reference to preferred embodiments, workers skilled in the art will recognize that changes may be made in form and detail without departing from the spirit and scope of the invention.

The invention claimed is:

1. An insulation piercing connector comprising:

a first jaw including a first set of insulation-piercing elements, which are arranged along orthogonal x-y coordinates; and a second jaw including a second set of insulation-piercing elements, which are arranged along the orthogonal x-y coordinates, wherein the first jaw opposes the second jaw and is moveable relative to the second jaw along an orthogonal z-coordinate, and wherein the first and second set of insulation-piercing elements are arranged such that at least one y-coordinate-extending row of insulation-piercing elements of the first set of insulation-piercing elements is able to form a non-contacting intermesh with at least one y-coordinate-extending row of insulation-piercing elements of the second set of insulation-piercing elements along the x-y coordinates when the first jaw is moved towards the second jaw along the z-coordinate.

2. The connector of claim 1, wherein the first set and second set of insulation-piercing elements have initial cable contact surfaces which are aligned along an arc, relative to an axis of a cable engaged therebetween.

3. The connector of claim 1, wherein the insulation-piercing elements are each formed of a material selected from a group consisting of aluminum, copper, and brass.

4. The connector of claim 1, wherein the first set of insulation-piercing elements has a first arrangement, and the second set of insulation-piercing elements has a second arrangement, where the first and second arrangements are reverse mirror images of one another.

5. The connector of claim 1, wherein the insulation-piercing elements are each formed in a shape selected from a group consisting of pyramid, triangle, or a fraction of a circle.

6. The connector of claim 1, wherein the connector has a cable range taking ratio of at least about 1:6.

7. The connector of claim 1, wherein the insulation-piercing elements are shaped such that the number of the insulation-piercing elements contacting a cable engaged between the first and second jaws remains substantially constant for substantially all cable sizes within a cable range taking capability of the connector.

8. A device for forming an electrical connection to an insulated cable, the device comprising:

a first jaw including a first set of inner insulation-piercing elements and a first set of outer insulation-piercing elements; and a second jaw including a second set inner insulation-piercing elements and a second set of outer insulation-piercing elements, wherein the first jaw opposes the second jaw, and wherein the first and second set of outer insulation-piercing elements are arranged such that the first and second sets of outer insulation-piercing elements are able to form a non-contacting intermesh along orthogonal x-y coordinates when the first jaw is moved towards the second jaw along an orthogonal z-coordinate.

9. The device of claim 8, wherein the outer insulation-piercing elements have a greater dimension along the z-coordinate than the inner insulation-piercing elements.

10. The device of claim 8, wherein each set of inner insulation-piercing elements and outer insulation-piercing elements have initial cable contact surfaces which are aligned along an arc relative to an axis of a cable engaged therebetween.

11. The device of claim 8, wherein the insulation-piercing elements are each formed of a material selected from a group consisting of aluminum, copper, and brass.

12. The device of claim 8, wherein the insulation-piercing elements are shaped such that the number of the insulation-piercing elements contacting a cable engaged between the first and second jaws remains substantially constant for substantially all cable sizes within a cable range taking capability of the device.

13. The device of claim 8, wherein the device has a cable range taking ratio of at least about 1:6.

14. The device of claim 8, wherein the first set of inner and outer insulation-piercing elements has a first arrangement and the second set of inner and outer insulation-piercing elements has a second arrangement, where the first and second arrangements are reverse mirror images of one another.

15. An electrical connector comprising:

a first jaw including a first set of teeth for piercing an insulative coating of a cable to electrically contact a conductive core of the cable; and a second jaw opposing the first jaw, the second jaw including a second set of teeth for piercing the insulative coating of the cable to electrically contact the conductive core of the cable;

wherein selected teeth from the first set of teeth and corresponding selected teeth from the second set of teeth form matching opposed arrays, and wherein the opposed teeth of each matching array are arranged on their respective jaws in an offsetting intermesh such that they do not contact one another when the first and second jaws are moved together to engage the cable, and further wherein the electrical connector has a cable diameter range taking capability of at least one to two.

16. The electrical connector of claim 15, wherein each set of teeth have initial cable contact surfaces which are aligned along an arc, relative to an axis of a cable engaged therebetween.

17. The electrical connector of claim 15, wherein each tooth is formed of a material selected from a group consisting of aluminum, copper, and brass.

18. The electrical connector of claim 15, wherein the electrical connector has a cable range taking ratio of at least about 1:6.

19. The electrical connector of claim 15, wherein the first set of teeth has a first arrangement, and the second set of teeth has a second arrangement, where the first and second arrangements are reverse mirror images of one another.

20. The electrical connector of claim 15, wherein the teeth are shaped such that the number of teeth contacting a cable engaged between the first and second jaws remains substantially constant for substantially all cable sizes within the cable diameter range taking capability of the electrical connector.

* * * * *